US012808313B2

(12) United States Patent
Panciroli et al.

(10) Patent No.: US 12,808,313 B2
(45) Date of Patent: Nov. 24, 2026

(54) METHOD TO CONTROL COMBUSTION INSIDE A BURNER OF AN EXHAUST GAS AFTER-TREATMENT SYSTEM

(71) Applicant: MARELLI EUROPE S.P.A., Corbetta (IT)

(72) Inventors: Marco Panciroli, Corbetta (IT); Umberto Di Martino, Corbetta (IT); Riccardo Patera, Corbetta (IT)

(73) Assignee: MARELLI EUROPE S.P.A., Corbetta (IT)

( * ) Notice: Subject to any disclaimer, the term of this patent is extended or adjusted under 35 U.S.C. 154(b) by 60 days.

(21) Appl. No.: 18/958,711

(22) Filed: Nov. 25, 2024

(65) Prior Publication Data

US 2025/0207520 A1 Jun. 26, 2025

(30) Foreign Application Priority Data

Dec. 21, 2023 (IT) ..... 102023000027690

(51) Int. Cl.
*F01N 3/20* (2006.01)

(52) U.S. Cl.
CPC ..... *F01N 3/2033* (2013.01); *F01N 2560/08* (2013.01); *F01N 2900/0404* (2013.01)

(58) Field of Classification Search
CPC .... F01N 11/00; F01N 11/002; F01N 2240/14; F01N 2900/1406; F01N 2900/0404; F01N 2900/0422; F01N 2900/1808; F01N 3/2033; F01N 3/025; F01N 2560/08; F01N 9/00; F01N 9/002; F01N 3/204; F01N 3/36; F01N 3/38; F01N 3/0256; F01N 2900/04; F01N 2900/18; F01N 2560/14; F02D 41/22; F02D 41/027; F02D 2041/224; F23N 5/00; F23N 5/26; F23N 5/16; F23N 2225/04
(Continued)

(56) References Cited

U.S. PATENT DOCUMENTS 8,396,689 B2 * 3/2013 Pfeifer ..... F04D 27/001 702/182
2022/0136423 A1 5/2022 Hemminger et al.
(Continued)

FOREIGN PATENT DOCUMENTS

DE 102020211089 A1 3/2022
EP 4134527 A1 2/2023
EP 4174296 A1 5/2023

OTHER PUBLICATIONS

Search Report for Italian Patent Application No. 202300027690 dated Jun. 5, 2024.

*Primary Examiner* — Devon C Kramer
*Assistant Examiner* — Kelsey L Stanek
(74) *Attorney, Agent, or Firm* — Howard & Howard Attorneys PLLC

(57) ABSTRACT

A method to control combustion inside the combustion chamber of a burner of an exhaust gas after-treatment system is described. The method provides for placing a first pressure sensor along a first duct of the exhaust gas after-treatment system; acquiring the signal detected by said first pressure sensor, processing the signal detected by the first pressure sensor determining the energy content thereof; calculating a combustion index; and recognising a failed combustion event inside the combustion chamber in case the combustion index is smaller than a threshold value.

22 Claims, 2 Drawing Sheets

(58) Field of Classification Search
USPC ..... 60/286
See application file for complete search history.

(56) References Cited

U.S. PATENT DOCUMENTS

| | | | | |
|---|---|---|---|---|
| 2023/0003156 | A1* | 1/2023 | De Cesare | F01N 3/32 |
| 2023/0049216 | A1* | 2/2023 | Garagnani | F01N 3/035 |
| 2023/0258117 | A1* | 8/2023 | Zhang | G07C 5/0816 701/29.4 |
| 2025/0092813 | A1* | 3/2025 | Krein | F01N 9/00 |

* cited by examiner

METHOD TO CONTROL COMBUSTION INSIDE A BURNER OF AN EXHAUST GAS AFTER-TREATMENT SYSTEM

CROSS-REFERENCE TO RELATED APPLICATIONS

This patent application claims priority from Italian patent application no. 102023000027690 filed on Dec. 21, 2023, the entire disclosure of which is incorporated herein by reference.

TECHNICAL FIELD

The present invention relates to a method to control combustion inside a burner of an exhaust gas after-treatment system.

PRIOR ART

As is known, an internal combustion engine is typically provided with a number of cylinders, each of which is connected to an intake manifold and to an exhaust manifold, to which an exhaust duct is connected which supplies the exhaust gases produced by combustion to an exhaust system, which emits the gases produced by combustion into the atmosphere.

An exhaust gas after-treatment system usually comprises a pre-catalyst arranged along the exhaust duct; a particulate filter also arranged along the exhaust duct, downstream of the pre-catalyst; and a catalytic converter arranged along the exhaust duct, upstream of the particulate filter. Finally, the exhaust gas after-treatment system finally also comprises a burner designed to introduce exhaust gases (and consequently heat) into the exhaust duct so as to quicken the heating of the catalytic converter and so as to facilitate the regeneration of the particulate filter.

The need is increasingly felt to be able to check, in a quick and reliable manner, the combustion inside said burner; in particular, it is of fundamental importance to be able to recognise, in a quick and reliable manner, when failed combustion events (misfire) occur inside the burner.

DESCRIPTION OF THE INVENTION

The object of the present invention is to provide a method for controlling combustion inside a burner of an exhaust gas after-treatment system, which is devoid of the above-described drawbacks and, in particular, is easy and cost-effective to implement.

According to the present invention, a method for controlling combustion inside a burner of an exhaust gas after-treatment system is provided, according to what is claimed in the appended claims.

BRIEF DESCRIPTION OF THE DRAWINGS

The present invention will now be described with reference to the accompanying drawings, which illustrate a non-limiting example embodiment thereof, wherein.

PREFERRED EMBODIMENTS OF THE INVENTION

Figure 1:
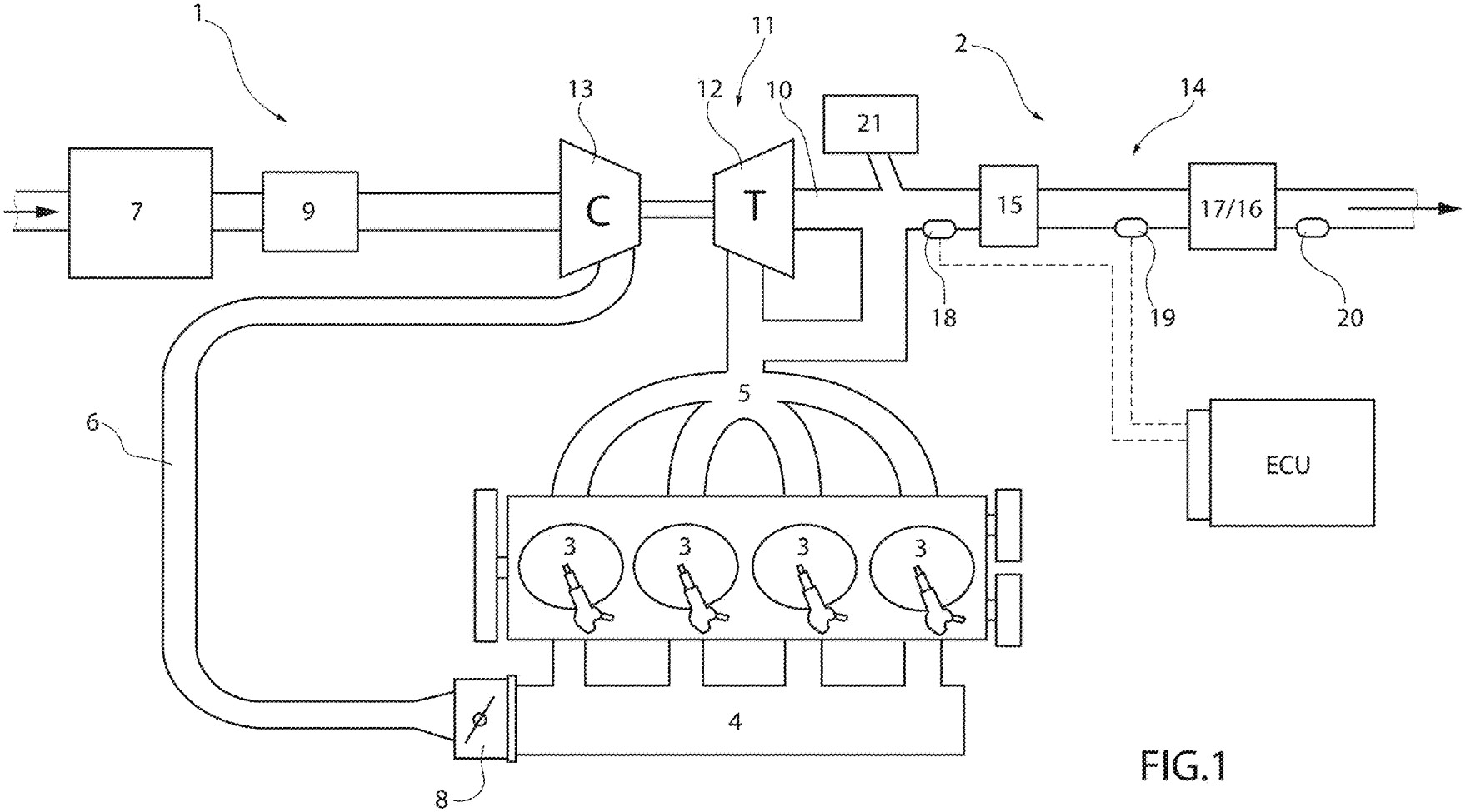
FIG. 1 schematically shows an internal combustion engine provided with an exhaust gas after-treatment system and with an electronic control unit for implementing the method object of the present invention.

In FIG. 1, reference numeral 1 indicates, as a whole, a supercharged internal combustion engine, provided with an exhaust system 2 of the exhaust gases in a motor vehicle (not illustrated) and having a number of cylinders 3, each of which is connected to an intake manifold 4 and to an exhaust manifold 5 via at least one respective exhaust valve (not illustrated).

The intake manifold 4 receives a gas mixture which comprises both exhaust gases and fresh air, i.e. air coming from the external environment through an intake duct 6, which is provided with an air filter for the flow of fresh air and is adjusted by a throttle valve 8. Along the intake duct 6 downstream of the air filter 7, also a flow meter 9 (better known as Air Flow Meter) is arranged.

To the exhaust manifold 5 an exhaust duct 10 is connected which supplies the exhaust gases produced by the combustion to the exhaust system 2, which emits the gases produced by the combustion into the atmosphere.

The supercharged internal combustion engine 1 comprises a supercharging system of the internal combustion engine 1, made by means of a turbocharger 11 provided with a turbine 12, which is arranged along the exhaust duct 10 for rotating at high speed under the action of the exhaust gases expelled from the cylinders 3, and a compressor 13, which is arranged along the intake duct 6 and is mechanically connected to the turbine 12 so as to be driven into rotation by the turbine 12 in order to increase the pressure of the air present in the supply duct 6.

The exhaust system 2 of the gases is provided with an exhaust gas after-treatment system 14 comprising a pre-catalyst 15 arranged along the exhaust duct 10, downstream of the turbocharger 11 and a particulate filter 16 (also known as Gasoline Particulate Filter) also arranged along the exhaust duct 10, downstream of the pre-catalyst 15. According to a preferred variation, the exhaust gas after-treatment system 14 is provided with a catalytic converter 17 arranged along the exhaust duct 10, upstream of the particulate filter 16. According to a preferred embodiment, the catalytic converter 17 and the particulate filter 16 are arranged one after the other inside a common tubular container.

According to a preferred variation, the internal combustion engine 1 is further provided with a linear oxygen probe 18 of UHEGO or UEGO type located along the exhaust duct 10 and interposed between the turbocharger 11 and the pre-catalyst 15; with a lambda probe 19 located along the exhaust duct 10 and interposed between the pre-catalyst 15 and the assembly defined by the catalytic converter 17 and the particulate filter 16 for detecting the concentration of oxygen inside the exhaust gases downstream of the pre-catalyst 15; and finally, a lambda probe 20 located along the exhaust duct 10 and arranged downstream of the assembly defined by the catalytic converter 17 and the particulate filter 16 for detecting the concentration of oxygen inside the exhaust gases downstream of the assembly defined by the catalytic converter 17 and the particulate filter 16.

The exhaust gas after-treatment system 14 then comprises a burner 21 designed to introduce exhaust gases (and consequently heat) into the exhaust duct 10 so as to quicken the heating of the pre-catalyst 15 and/or of the catalytic converter 17 and so as to facilitate the regeneration of the particulate filter 16. The burner 21 is arranged so as to introduce the exhaust gases into the exhaust duct 10 upstream of the pre-catalyst 15 or upstream of the catalytic converter 17.

Figure 2:
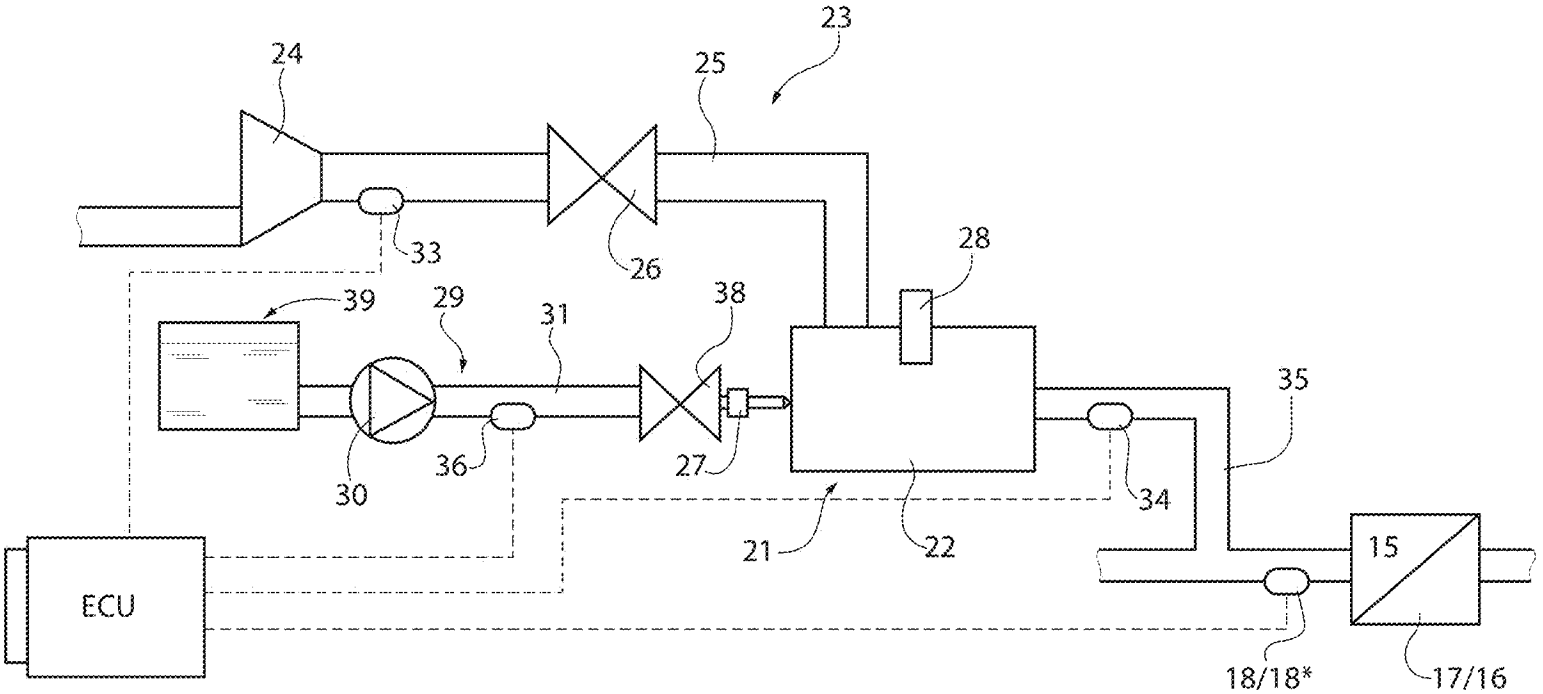
FIG. 2 schematically illustrates the exhaust gas after-treatment system of FIG. 1.

According to what is better illustrated in FIG. 2, inside the burner 21, a combustion chamber 22 is defined which receives fresh air (i.e. air coming from the external environment) via an air supply circuit 23 provided with a pumping device 24 (of known type and not specifically described), preferably with the interposition of an air filtering element, and supplies air to the burner 21 by means of a duct 25. According to a first embodiment, the pumping device 24 is of the fixed flow rate type and a shut-off valve 26 is provided located along the duct 25 (arranged downstream of the pumping device 24) for adjusting the air flow. Alternatively, the pumping device 24 is of the variable flow rate type (controlled in PWM) and a non-return valve 26 is provided located along the duct 25 (arranged downstream of the pumping device 24).

The combustion chamber 22 further receives the fuel from an injector 27, set up to inject the fuel inside the combustion chamber 22. Furthermore, a spark plug 28 is coupled to the burner 21 for determining the ignition of the mixture present inside the combustion chamber 22. The internal combustion engine 1 then comprises a fuel supply circuit 29 provided with a pumping device 30 which draws from a tank 39 and supplies the fuel by means of a duct 31, adjusted by a valve 38.

The air-fuel mixture which is introduced into the combustion chamber 22 is defined rich (or fat) in case of an excess of fuel with respect to the stoichiometric value and is defined lean (or poor) in case of an excess of air with respect to the stoichiometric value. As is known, conventionally, lambda A represents the coefficient of air in excess relative to the air-fuel mixture in stoichiometric conditions. For rich mixtures, lambda A is smaller than one and for lean mixtures lambda A is greater than one.

The probes 18, 19, 20 are made for detecting/measuring the amount of oxygen present in the exhaust gases and for providing, alternatively, a binary output of on/off type or a linear output, which indicates the content of oxygen in the exhaust gases for allowing an electronic control unit (normally called "ECU") to calculate the air/fuel ratio of the exhaust gases. In other words, the probes 18, 19 and 20 provide an output which indicates if the value of lambda A detected for the exhaust gases is above or below the stoichiometric value (i.e. one).

The internal combustion engine 1 finally comprises a control system 32, which is adapted to supervise the operation of the internal combustion engine 1. The control system 32 comprises at least the electronic control unit, which supervises the operation of the different components of the internal combustion engine 1. It is evident that the electronic control unit ECU introduced in the preceding discussion can be a dedicated electronic control unit ECU which supervises the operation of the burner 21 or can be the electronic control unit ECU which supervises the operation of the internal combustion engine 1. The spark plug 28 is driven by the electronic control unit ECU for making a spark strike between its own electrodes and thus for determining the ignition of the compressed gases inside the combustion chamber 22.

Finally, the control system 32 comprises a plurality of sensors connected to the electronic control unit ECU. The sensors comprise, in particular, a temperature and pressure sensor 33 of the air flow supplied to the burner 21 preferably located along the duct 25 (in other words, the sensor 33 is located along the duct 25 downstream of the pumping device 24, preferably interposed between the pumping device 24 and the shut-off valve 26); a pressure sensor 34 of the exhaust gases flowing out of the burner 21 located along an outlet duct 35; a pressure sensor 36 of the fuel supplied to the burner 21 located along the duct 31. The electronic control unit ECU is further connected to the linear oxygen probe 18 of UHEGO or UEGO type and the lambda probes 19, 20 from which it receives signals indicative of the air/fuel ratio of the exhaust gases.

In the following, the method implemented by the electronic control unit ECU for controlling combustion inside the combustion chamber 22 of the burner 21 is described.

Firstly, the method provides for acquiring the signal detected by the pressure sensor 34. More specifically, the signal is acquired by the electronic control unit ECU at a frequency of at least 10 kHz.

Preferably, the signal is acquired by the electronic control unit ECU at a frequency that is at least twice a listening frequency which is the distinctive oscillation frequency of the burner 21 (as it will be better described in the following discussion).

During the normal operation, the intensity of the pressure signal generated by the combustion in the burner 21 is thus detected by means of the sensor 34 and is stored in a buffer memory.

The pressure signal stored in the buffer memory relates to a first moving listening interval between two time instants $t_1$ and $t_2$; wherein, $t_1$ represents the initial instant of the moving listening interval and $t_2$ represents the final instant of the moving listening interval. Preferably, the first moving listening interval has a predetermined and constant duration. Advantageously, the first moving listening interval has a duration ranging from 5 ms to 15 ms; in particular, the first moving listening interval has a duration of 10 ms.

Advantageously, the first moving listening interval between two time instants $t_1$ and $t_2$ has a duration that is defined based on the features of the burner 21 and corresponds to a plurality of pulsations, preferably three or four pulsations, of the signal detected by the pressure sensor 33.

A given number n of time-based samples detected by the pressure sensor and relative to the first moving listening interval are stored in the memory buffer.

Subsequently, the electronic control unit ECU is preferably configured to apply a filter in a range of distinctive oscillation frequencies of the burner 21. In other words, the electronic control unit ECU is configured to filter the evolution over time of the pressure signal with a filter which can alternatively be a hardware filter or a software filter. Preferably, the filter is a band-pass filter; i.e. a first order filter which allows the passage of frequencies inside a passband of listening frequencies and mitigates the frequencies outside the passband.

In particular, the applicant experimentally checked that, when the burner 21 is ignited, the pressure signal detected by the sensor 34 has a marked component around 300 Hz, a value that represents the listening frequency. Advantageously, the listening frequency is that of quarter-wave oscillation.

In particular, observing the trend of the pressure over time, with the internal combustion engine 1 in combustion at 1500 rpm and varying the injection frequency of the fuel in the burner 21 (i.e. at 50, 100 and 150 Hz), the applicant experimentally checked that the main pulsation of the pressure remains the same, substantially around 300 Hz. This value represents the quarter-wave pressure oscillation in the burner 21; more specifically, the burner 21 is assimilated to an equivalent pipe with a first open end (which identifies the point of confluence in the exhaust duct 10) and a second closed end. It was further observed that the quarter-wave pressure oscillation in the burner 21 is substantially independent of the injection frequency and of the combustion. Each combustion determines an increase in local pressure which makes the burner 21 resonate in a quarter-wave manner; the frequency f is directly proportional to the speed $V_S$ of the sound and inversely proportional to 4 times the length of the duct according to the relation:

$$f = (2n+1) * V_s/4L$$

where 2n+1 is the number of the harmonics with n=0, 1, 2, 3 . . . .

The speed $V_S$ of the sound is in turn function of the temperature T, of the constant R of the gases and of the ratio $\gamma$ of the specific heats at constant pressure $c_P$ and constant volume $c_V$ (i.e. $\gamma = c_P/c_V$), respectively, according to the relation:

$$V_s = (\gamma * R * T)^{1/2}$$

The first harmonic with n=0 thus has frequency $f_1 = V_S/4L$. Considering the speed of the flow V in the burner 21 and the average section of radius r, the period $T_P$ of oscillation of the pressure in the duct and the relative frequency fc can be calculated as follows:

$$T_p = 2 * (L + 0,6r) * \left(1/(V_s + V) + 1/(V_s - V)\right) f_C = 1/T_p$$

The frequency results to be equal to 341 Hz assuming an average temperature of 1000° C., a length L of the burner equal to 0.52 m, an average radius r equal to 0.03 m, an air mass flow rate of 30 kg/h and a stoichiometric combustion title.

Advantageously, the range of listening frequencies or passband ranges from 250 to 350 Hz. In other words, the band-pass filter is made for allowing the passage of frequencies in a range of distinctive oscillation frequencies of the burner 21.

The range of listening frequencies relates to the oscillation of the pressure in the burner 21 and in the piping. Therefore, the range of listening frequencies is variable depending on the layout (essentially on the length of the piping) of the exhaust gas after-treatment system, on the geometry of the burner 21 and on the physical features of the gas (pressure, temperature, etc.).

Subsequently, the electronic control unit ECU is set up to calculate a combustion index for the first moving listening interval. The combustion index is an indicator of the fact that the combustion event inside the burner 21 has or has not occurred.

More specifically, the combustion index represents an indicator of the combustion inside the combustion chamber 22 based on the energy content of the detected pressure signal. Energy content of the pressure signal means its variation over time in the first moving listening interval, with respect to its average value in said first moving listening interval. The energy content is null if the pressure signal is constant in the first moving listening interval, whereas it will be greater than zero if the signal varies with respect to its average value in the first moving listening interval. In substance, the energy content can be evaluated as the average integral of the deviation in absolute value with respect to the average value in the first moving listening interval.

More specifically, according to a first and preferred embodiment, the combustion index for the first moving listening interval is defined by the effective value or RMS (root mean square) value in the instant $t_2$ calculated as follows:

$$I(t_2) = \sqrt{\frac{1}{n} * \sum_{i=1}^{n} [Pf_i]^2} \quad [1]$$

n number of samples; and $Pf_i$ value filtered via a band-pass filter of the pressure signal for the i-th sample.

In this case, it is not necessary to evaluate the deviation with respect to the average since we use a value filtered via a band-pass filter of the pressure signal for the i-th sample; the band-pass filter is made for providing the oscillation component with respect to the tendentially null value.

Advantageously, according to a second embodiment, the combustion index for the first moving listening interval is defined by the moving average absolute deviation S (in alternative to the RMS value) in the instant $t_2$ calculated as follows:

$$S(t_2) = \frac{(|x_1 - M| + \ldots + |x_n - M|)}{n} \quad [2]$$

n number of samples;

$x_i$ value filtered via a band-pass filter of the pressure signal for the i-th sample; and M moving average of the combustion index for the first moving listening interval.

Advantageously, according to a third embodiment, the combustion index for the first moving listening interval is defined by the moving variance $\sigma^2$ (in alternative to the RMS value or to the moving average absolute deviation S) in the instant $t_2$ calculated as follows:

$$\sigma^2(t_2) = \frac{\left[(x_1 - M)^2 + \ldots + (x_n - M)^2\right]}{n} \quad [3]$$

n number of samples;

$x_i$ value filtered via a band-pass filter of the pressure signal for the i-th sample; and M moving average of the combustion index for the first moving listening interval.

In other words, with respect to the formula [2] or [3], the combustion index is calculated for the first moving listening interval using the sum of the squares of the differences between the value $x_i$ of the i-th pressure sample and the moving average M of said values $x_i$ of the pressure samples.

Advantageously, according to a fourth and last embodiment, the combustion index for the first moving listening interval is defined by the moving standard deviation $\sigma$ or moving average square deviation (in alternative to the RMS value or to the moving average absolute deviation S or to the moving variance $\sigma^2$) in the instant $t_2$ calculated as follows:

$$\sigma(t_2) = \sqrt{\frac{[(x_1 - M)^2 + \ldots + (x_n - M)^2]}{n}} \quad [4]$$

n number of samples;

$x_i$ value filtered via a band-pass filter of the pressure signal for the i-th sample; and M moving average of the combustion index for the first moving listening interval.

In other words, with respect to the formula [2], the combustion index is calculated for the first moving listening interval using the square root of the ratio between the sum of the squares of the differences between the value $x_i$ of the i-th pressure sample and the moving average M of said values $x_i$ of the pressure samples and the number n of the samples.

Once the combustion index for the first moving listening interval has been calculated, the electronic control unit ECU is set up to compare the combustion index with at least one threshold value. More specifically, the electronic control unit ECU is set up to compare the combustion index with a (first) threshold value $TV_{OFF}$ and with a (second) threshold value $TV_{ON}$. Advantageously, the (first) threshold value $TV_{OFF}$ is greater than the (second) threshold value $TV_{ON}$.

In case the combustion index is smaller than the (first) threshold value $TV_{OFF}$, the electronic control unit ECU is set up to recognise a failed combustion event (misfire) inside the burner 21. In general, the electronic control unit ECU is set up to recognise the absence of combustion.

Similarly, in case the combustion index is greater than the (second) threshold value $TV_{ON}$, the electronic control unit ECU is set up to recognise the occurrence of a combustion event inside the burner 21. In particular, the electronic control unit ECU is arranged to recognise the instant of start of combustion (also known as SOC—Start of Combustion).

According to a preferred embodiment, during the normal operation, the value of the combustion index relative to a (second) moving listening interval between two time instants $t_3$ and $t_4$ is stored in the buffer memory; wherein $t_3$ represents the initial instant of the moving interval and $t_4$ represents the final instant of the moving interval. Advantageously, the time instant $t_4$ corresponds to the time instant $t_2$. Preferably, the second moving interval has a predetermined and constant duration. Advantageously, the second moving interval has a duration ranging from 80 ms to 120 ms; in particular, the second moving listening interval has a duration of 100 ms.

The duration of the second moving listening interval is greater than the duration of the first moving listening interval.

A given number n of time-based samples of the combustion intensity value relative to the second moving interval are stored in the memory buffer.

Subsequently, the electronic control unit ECU is set up to calculate the moving average M1 of the combustion index for the second moving interval. The moving interval M1 of the combustion index for the second moving interval is used as indicator of the intensity of the combustion inside the burner 21. Also in this case, once the moving average M1 of the combustion index for the second moving interval has been calculated, the electronic control unit ECU is set up for comparing the moving average M1 of the combustion index for the second moving interval with a respective threshold value. In case the moving average M1 of the combustion index for the second moving listening interval is smaller than the respective threshold value, a malfunction is signaled.

Finally, the electronic control unit ECU is set up to calculate the moving standard deviation σ or the moving average square deviation in the instant $t_4$ for the second moving interval as follows:

$$\sigma(t_4) = \sqrt{\frac{[(x_1 - M1)^2 + \ldots + (x_m - M1)^2]}{m}} \quad [5]$$

m number of samples;

$x_i$ i-th value of the combustion index; and

M1 moving average of the combustion index for the second moving interval.

The moving standard deviation σ for the second moving listening interval is used as indicator of the stability of the combustion inside the burner 21. Also in this case, once the moving standard deviation σ has been calculated, the electronic control unit ECU is set up to compare the moving standard deviation σ with a respective threshold value. In case the moving standard deviation σ is smaller than the respective threshold value, a malfunction is signaled.

In the preceding discussion explicit reference was made to the case where the signal detected by the pressure sensor 34 is acquired; alternatively, the method described so far can be advantageously applied also using the pressure signal detected by the temperature and pressure sensor 33 of the air flow supplied to the burner 21 or the difference between the pressure signals detected by the pressure sensors 33, 34.

Alternatively, the method described so far can be advantageously applied also using the pressure signal detected by a differential sensor configured to detect the difference between the pressure of the air flow supplied to the burner 21 along the duct 25 and the pressure of the exhaust gases flowing out of burner 21 along the duct 35.

LIST OF REFERENCE NUMERALS OF REFERENCE

1 internal combustion engine
2 exhaust system
3 cylinders
4 intake manifold
5 exhaust manifold
6 intake duct
7 air filter
8 throttle valve
9 flow meter
10 exhaust duct
11 turbocharger
12 turbine
13 compressor
14 after-treatment system
15 pre-catalyst
16 particulate filter
17 catalytic converter
18 linear probe
19 lambda probe
20 lambda probe
21 burner
22 combustion chamber
23 air supply circuit
24 pumping device
25 duct

26 shut-off valve
27 injector
28 spark plug
29 fuel supply circuit
30 pumping device
31 duct
33 sensor P, T
34 sensor P, T
35 outlet duct
36 sensor P, T
38 valve
39 fuel tank
ECU electronic control unit

The invention claimed is:

1. A method to control combustion inside a combustion chamber of a burner of an exhaust gas after-treatment system designed to introduce exhaust gases into an exhaust duct (10); the method-comprising the steps of:

placing a first pressure sensor along a first duct of the exhaust gas after-treatment system;

acquiring a signal detected by said first pressure sensor in a first moving listening interval between an initial instant and a final instant ($t_1$, $t_2$);

processing and determining an energy content of the signal detected by the first pressure sensor;

calculating a combustion index, which represents an indicator of the combustion inside the combustion chamber, based on the energy content of the signal detected by the first pressure sensor;

comparing said combustion index with a first threshold value ($TV_{OFF}$);

recognizing a failed combustion event inside the combustion chamber when the combustion index is smaller than the first threshold value ($TV_{OFF}$);

signaling a malfunction of the burner when the failed combustion event is recognized and controlling the operation of the burner based on the recognized failed combustion event.

2. The method according to claim 1, wherein the processing step includes a sub-step of applying a filter in a range of distinctive oscillation frequencies of the burner.

3. The method according to claim 2, wherein the filter can alternatively be a hardware filter or a software filter.

4. The method according to claim 2, wherein the filter is a band-pass filter.

5. The method according to claim 2, wherein the range of distinctive oscillation frequencies of the burner is variable depending on a layout of the exhaust gas after-treatment system, on a geometry of the burner and on physical features of the exhaust gases.

6. The method according to claim 2, wherein the filter is applied in a range of frequencies ranging from 250 to 350 Hz.

7. The method according to claim 2, wherein the range of distinctive oscillation frequencies of the burner is near an injection frequency.

8. The method according to claim 1 further including the step of recognizing the combustion event, by:

comparing said combustion index with a second threshold value ($TV_{ON}$), wherein the first threshold value ($TV_{OFF}$) is greater than the second threshold value ($TV_{ON}$); and recognizing the occurrence of a combustion event inside the combustion chamber when the combustion index is greater than the second threshold value ($TV_{ON}$).

9. The method according to claim 1, wherein the first moving listening interval between the initial instant and the final instant ($t_1$, $t_2$) has a duration that corresponds to a plurality of pulsations of the signal detected by the first pressure sensor.

10. The method according to claim 9, wherein the first moving listening interval between the initial instant and the final instant ($t_1$, $t_2$) has a duration ranging from 5 ms to 15 ms.

11. The method according to claim 1, wherein the step of calculating the combustion index for the first moving listening interval further includes using an effective root mean square (RMS) value in the final instant ($t_2$) determined by:

$$I(t_2) = \sqrt{\frac{1}{n} * \sum_{i=1}^{n} [Pf_i]^2}$$

Where:

n represents-number of samples; and $Pf_i$ represents a filtered value of the i-th pressure sample.

12. The method according to claim 1, wherein the step of calculating the combustion index for the first moving listening interval further includes using a moving average absolute deviation (S) in the final instant ($t_2$) determined by:

$$S(t_2) = \frac{(|x_1 - M| + \ldots + |x_n - M|)}{n}$$

Where:

n represents the number of samples;

$x_i$ represents the valve of an i-th pressure sample; and

M represents the moving average of the values $x_i$.

13. The method according to claim 12, wherein the step of calculating the combustion index for the first moving listening interval further includes using a ratio between the sum of squares of differences between a value ($x_i$) of an i-th pressure sample and the moving average (M) of said values ($x_i$) of the pressure samples and the number (n) of samples.

14. The method according to claim 13, wherein the step of calculating the combustion index for the first moving listening interval further includes using the square root of the ratio between the sum of the squares of the differences between the value ($x_i$) of the i-th pressure sample and the moving average (M) of said values ($x_i$) of the pressure samples and the number (n) of the samples.

15. The method according to claim 1 further including the steps of:

calculating the value of the combustion index in a second moving interval ($t_3$, $t_2$, $t_4$), whose duration is greater than the duration of the first moving listening interval; and calculating a moving average (M1) of the combustion index for the second moving listening interval and using it as an indicator of the intensity of the combustion inside the burner (21).

16. The method according to claim 15, wherein the second moving interval has a duration ranging from 80 ms to 120 ms.

17. The method according to claim 15, further including the step of calculating a moving standard deviation of the combustion index for the second moving interval and using it as an indicator of the stability of the combustion inside the burner.

18. The method according to claim 1, wherein the step of acquiring the signal detected by said first pressure sensor is carried out at a frequency that is at least twice the distinctive oscillation frequency of the burner and is at least 10 KHz.

19. The method according to claim 1, wherein the first pressure sensor is configured to detect the pressure of the exhaust gases flowing out of the burner and is located along the first duct connecting the burner to the exhaust duct.

20. The method according to claim 1, wherein the first pressure sensor is configured to detect the pressure of the air flow supplied to the burner along the first duct.

21. The method according to claim 1 further including the steps of:

placing the first pressure sensor along the first duct connecting the burner to the exhaust duct so as to detect the pressure of the exhaust gases flowing out of the burner;

placing a second pressure sensor, which is configured to detect the pressure of the air flow supplied to the burner, along a second duct;

processing the signal detected by said first and second pressure sensors; and using the difference between the signals detected by said first and second pressure sensors to calculate the combustion index.

22. The method according to claim 1, wherein the first pressure sensor is a differential sensor and is configured to detect the difference between the pressure of the air flow supplied to the burner along a second duct and the pressure of the exhaust gases flowing out of the burner along the first duct connecting the burner to the exhaust duct.

* * * * *